United States Patent [19]

Gajjar

[11] 4,020,654

[45] May 3, 1977

[54] METHOD OF WARP KNITTING

[75] Inventor: Bharat Jaybhadra Gajjar, Wilmington, Del.

[73] Assignee: E. I. Du Pont de Nemours and Company, Wilmington, Del.

[22] Filed: July 29, 1976

[21] Appl. No.: 709,660

Related U.S. Application Data

[63] Continuation-in-part of Ser. No. 620,835, Oct. 8, 1975.

[52] U.S. Cl. ..... 66/125 R; 66/213; 66/203

[51] Int. Cl.[2] ..... D04B 3/06; D04B 15/48; D04B 27/10; D04B 35/00

[58] Field of Search ..... 66/125, 203, 209, 195, 66/213

[56] References Cited

UNITED STATES PATENTS

| | | | |
|---|---|---|---|
| 1,234,927 | 7/1917 | Myers et al. | 66/125 |
| 3,861,175 | 1/1975 | Farmer | 66/213 |

*Primary Examiner*—Ronald Feldbaum

[57] ABSTRACT

A two-bar warp-knitted fabric with surface interest patterning is formed from two sets of threads being fed to separate guide bars of a warp knitting machine then to a single needle bed for knitting by crossing at least one of the threads from one set of threads from one operating guide bar to the other. The preferred embodiment interchanges some threads from one set with threads of the other set ahead of the guide bars.

16 Claims, 14 Drawing Figures

STITCH
FRONT BAR
BACK BAR

JERSEY
2-3, 1-0
1-0, 1-2
41
42

MODIFIED JERSEY
1-0, 2-3
2-3, 1-0

REVERSE JERSEY
1-0, 1-2
2-3, 1-0

LONG-FLOAT JERSEY
3-4, 1-0
1-0, 1-2

STABILIZED
1-0, 0-1
3-4, 1-0

TAFFETA
1-0, 0-1
1-0, 4-5

SHORT-FLOAT DELAWARE
1-2, 1-0
1-0, 0-1

DELAWARE
2-3, 1-0
1-0, 0-1

LONG-FLOAT DELAWARE
3-4, 1-0
1-0, 0-1

SATIN-FLOAT DELAWARE
4-5, 1-0
1-0, 0-1
0 1 2 3 4 5
0 1 2 3 4 5

METHOD OF WARP KNITTING

CROSS REFERENCE TO RELATED APPLICATION

This is a continuation-in-part of my copending U.S. application Ser. No. 620,835, filed Oct. 8, 1975.

BACKGROUND OF THE INVENTION

This invention relates to warp knitted fabrics and more particularly to the method of knitting the fabrics to produce surface interest patterning.

Basic warp-knitting, to which this invention applies, comprises knitting on tricot or Raschelmachines using basic plain stitches, for example, Jersey or Delaware stitches, or their well-known variations. These knitted fabrics are characterized by unvarying stitch formation; i.e., all stitches in a given course are identically formed, and each course is formed exactly the same as alternating courses before and after it in the fabric. The front-bar and back-bar stitch patterns are different, but each starts in one course, ends in the next, and repeats for succeeding pairs of courses. Basic warp-knitting permits very high production rates, but the fabrics have only plain surface aesthetics free of any surface-interest patterning. The prior art includes many techniques for forming surface patterns in warp-knitted fabrics, but all of these known techniques involve complicted variation in stitch patterns, the laying in of extra ends in pattern-forming arrays, or like complications which diminish productivity and add to the cost of fabrics produced.

SUMMARY OF THE INVENTION

This invention provides a method for preparing fabrics having spaced warpwise visible line patterns using basic warp-knitting stitch constructions with their inherently high productivity rates. It also provides a warp-knitted fabric with spaced warpwise visible line patterns. These advantages result from an improvement on a method for producing warp knitted fabrics on a warp knitting machine having at least two sets of warp threads and corresponding operating guide bars, that includes the steps of feeding one of the two sets of threads to one of two operating guide bars of the warp knitting machine and feeding the other of the two sets to the other operating guide bar of the warp knitting machine to form a knitted fabric. The improvement comprises: interchanging some of the threads from one set of threads with threads of the other of said set of threads in a spaced pattern ahead of the operating guide bars on the knitting machine.

DETAILED DESCRIPTION OF THE PREFERRED EMBODIMENT

"Basic warp-knitting", as intended herein, is best defined in terms of stitch patterns, as shown in FIGS. 1A to 1J. While many other patterns constituting basic warp-knitting are theoretically possible, the ones shown represent most of those used commercially. For each, a single needle-bar is employed, being fed from front-bar and back-bar warps of knitting yarns or threads. Knitting needle positions for each of two successive courses are represented in the diagrams by horizontal lines of dots, the top line representing the course formed immediately after the course represented by the bottom line. Only one front-bar and one back-bar yarn are shown in each instance, it being understood that one end of each is knitted on each knitting needle for every course. More particularly, referring to FIG. 1A the stitch construction of the fabric is notationally set out and shows that the threads of the front bar, one of which is indicated at 41, have back and forth movement to non-adjacent needles in successive courses as indicated by the numbers 2-3,1-0 and that the threads of the back bar, one of which is indicated as 42, have similar movements as indicated by the numbers 1-0,1-2. The Delaware stitches are particularly characterized by chain-stitched back-bar threads as indicated by the numbers 1-0,0-1 (FIGS. 1G-1J). These may be open stitches (as shown) or closed loops.

The fabric is preferably made according to the invention on a tricot or similar warp knitting machine employing a needle bar and at least two yarn guide bars respectively known as the back guide bar and the front guide bar. The needle bar is provided with knitting needles which may vary in number according to the gauge of the machine, and each guide bar has a number of yarn guides corresponding to the number of needles of the needle bar. The guide bars are able to be shogged under pattern control a distance of one or more needles in opposite directions lengthwise of the needle bar, and both bars are also swingable transversely of the needle bar to permit their yarn guides to pass between the needles, the combined shogging and swinging movements permitting the yarns to be fed to the needles and to be knit thereby.

Figure 2:
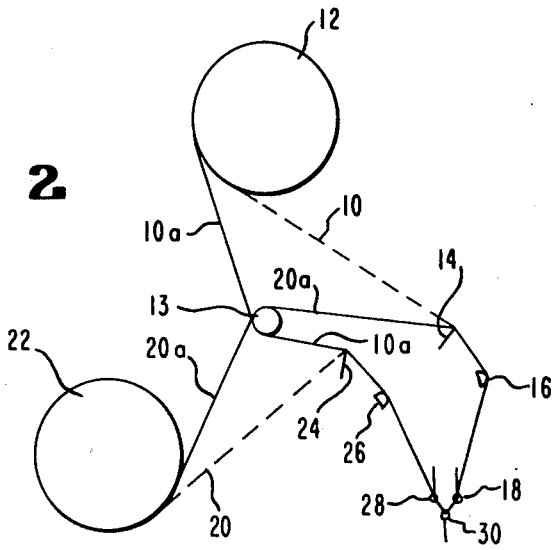
FIG. 2 is a schematic end elevation of the apparatus elements for basic warp knitting.
Figure 3:
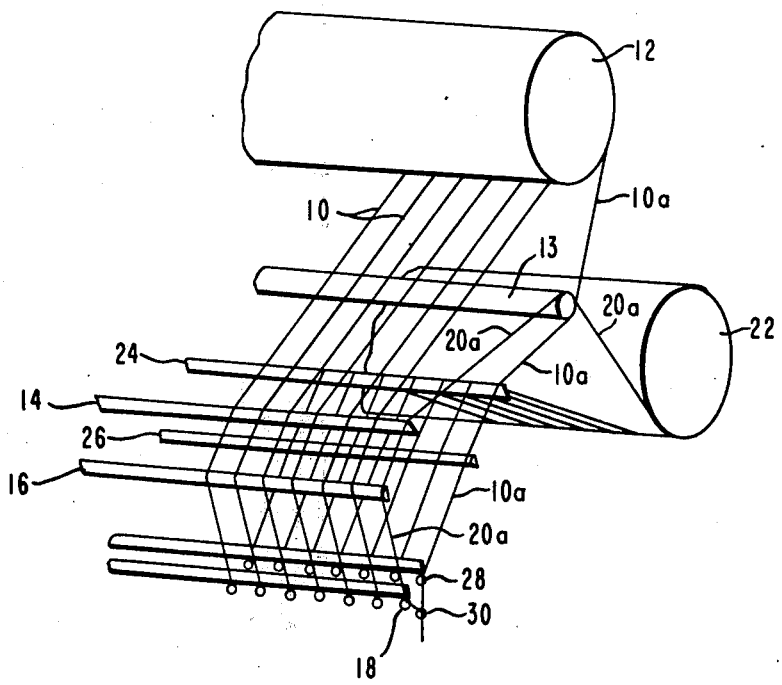
FIG. 3 is a partial front isometric view of FIG. 2 without the needle bed showing a pair of interchanged threads.

A schematic arrangement for such a knitting machine is shown in FIGS. 2 and 3. The top (or front) bar warp is fed from a warp-set of yarns or threads 10 on beam 12. The threads 10 pass in the usual well-known manner through a fixed reed 14, which serves to keep the threads separated in open dents (not shown), and over tension bar 16, which has a smooth yarn-contacting surface extending across the whole width of the warp. The tension bar is flexibly mounted to permit vibration and thus to tend to equalize tensions on the threads. From tension-bar 16, each end is then threaded through its guide in guidebar 18 and on to needle-bed 30. Similarly, the bottom (or back) bar warp is led from a warp-set of yarns or threads 20 on beam 22 via fixed reed 24, tension-bar 26, and guide-bar 28 to needle-bed 30. Knitting results from two kinds of motion, as is well known. The two guide-bars 18, 28 swing back and forth together along an arc in the plane of FIG. 2, and each is separately shogged into and out of the plane of FIG. 2 according to a preselected pattern.

While most ends from the two warp-set become threaded through the front guide-bar 18, as usual, spaced ends are instead threaded through the back guide-bar 28. Wherever the back guide-bar has front-bar ends, the displaced back-bar ends aare threaded through vacated guides in the front guide-bar, i.e., some ends such as 10a and 20a may simply be crossed by passing them around direction changing rod 13 before reaching the guide-bars 18, 28 so as to maintain both guide-bars full.

From examination of the stitch diagrams in FIGS. 1A to 1J, it is obvious that each front-bar stitch requires a length of yarn different from that of each back-bar stitch. This necessitates feeding the two warps 10, 20 at different rates. Therefore, it has been believed that crossing some of the ends of the two bars would inevitable generate yarn tensions great enough to break knitting needles and render continuous troublefree knitting impossible. Surprisingly, however, the only effect is the desirable one of distorting stitches along the warp-line of each pair of crossed ends to produce a visible line (or stripe) in the fabric.

The provision of warpwise line patterns in basic warp-knitted fabrics according to this invention results from crossing spaced front-bar and back-bar ends and does not require any specific differences in the yarns on the two bars. Thus, the two bars may be composed of identical yarns, or the yarns on one may differ from the other in, for example, shrinkage, denier, count,bulk, texture, crimp, tensile properties, and/or chemical composition as desired.

Similar patterning effects results from warp knitting using three or more sets of warp threads and corresponding guide bars. It is required only that some of the threads from one set of warp threads be interchanged with threads in one of the other warp sets in a spaced pattern ahead of the operating guide bars for the two sets of warp threads.

While the preferred embodiment achieves patterning effects when front and back bar threads are interchanged ahead of their guide bars substantially the same patterning effects result when only one end is crossed from one operating guide bar to the other.

Any yarns useful for known warp-knit processing may be used in making fabric according to this invention. Included are synthetic thermoplastic yarns in either filament or spun-stable form, yarns spun from natural fibers, and yarns from mixtures of synthetic and natural fibers.

Conventional finishing procedures are suitable for fabrics made according to this invention. In the examples, except for random selection of color of the disperse dyes used, all greige fabrics are finished identically. After heat setting for 30 seconds at 380° F (193°C) on a pin tenter frame at 10% overfeed and 5% underwidth, they are scoured, washed, dyed, and again-washed in a beck. Scouring is for 30 minutes at 180° F (82° C) using an aqueous dispersion of surfactant and emulsified hydrocarbon scouring solvent. Initial washing is for 20 minutes at 160° F (71° C) in water containing detergent. After five minutes at 120° F (49° C) in water containing wetting agent, dispersing agent, and a dye assist, pH is adjusted to 6 with acetic acid, the selected dye is added, and temperature is raised to 160° F (71°C) before adding butyl benzoate dye carrier. Dyeing continues at the boil for 90 minutes. Final washing identical to initial washing ends treatment in the beck. Finishing is completed by heat setting at 350° F (177° C) on a pin tenter frame at wet width and 5% overfeed.

The following terms are used in the Examples and are defined below:

Rack is defined as 480 consecutive courses (knitted rows) of stitches.

Runner length is the length of each yarn used in knitting one rack.

Quality denotes the length of one rack of knitted fabric.

Gauge specifies the number of knitting needles per inch (per 2.54 cm) in the needle bar.

Count (W/C) specifies the number of wales (W) and courses (C) per unit of length measured perpendicular to the fabric direction of each.

Greige (also, occasionally, "gray") describes untreated fabric just as it comes from the knitting machine. Before it is sold, the greige fabric is ordinarily treated by washing, scouring, dyeing, heat-setting, or the like, after which it is referred to as "finished"fabric.

In the examples, Yarns A and B are both of 30 denier (33.3 dtex) and are prepared substantially as described in Example I of Knospe, U.S. Pat. No. 3,416,302. Each filament has a trilobal cross-section as taught by Holland in U.S. Pat. No. 2,939,201. Yarn A has ten filaments, and yarn B has eighteen filaments. In each yarn, half of the filaments are composed substantially of PACM-12 homopolymer and the other half of PACM-12/PACM-I (90/10 by weight) copolymer. PACM denotes the polymer unit corresponding to bis-(4-aminocyclohexyl) methane; 12 denotes the polymer unit corresponding to dodecanedioic acid; and I denotes the polymer unit corresponding to isophthalic acid. The PACM employed contains 70% by weight of its trans-trans isomer.

The fabrics are warp knitted using standard twobar, fully threaded, tricot knitting machines. The top and back beams in each case feed normally beamed knitting yarns of the same description. As specified, three basic warp knitting stitches are employed with the following front bar/back bar knitting patterns:

Jersey stitch: 2-3,1-0/1-0,1-2

Delaware stitch: 2-3,1-0/1-0,0-1

Modified Jersey: 1-0,2-3/2-3,1-0

In each case, the only modification to otherwise standard and well-known knitting is the interchanging (crossing) of corresponding spaced front and back bar threads at a point between the respective beams and guide bars or the crossing of only one thread from one operating guide bar to another. The arrangement for crossing spaced threads is substantially as shown in and discussed in connection with FIG. 3. The distribution of crossed threads along consecutive guides in either guide bar is indicated by a series of symbols (O or X) where "O" denotes a normally threaded end and "X" denotes a cross thread, i.e., thread originating from the opposite beam from that which normally feeds the guide bar involved. Thus, OOXOOOXOOOOX represents a repeated distribution along successive positions on either guide bar where two threads are normally threaded, one is crossed, three are normally threaded, one is crossed, four are normally threaded, and one is crossed. Unlike customary Jersey or Delaware stitch fabrics, the fabrics of the examples exhibit atractive longitudinal waleshifted patterning which is readily varied for a multiplicity of patterned effects by selection of the spacing of crossed ends and the type of stitch employed. While,in the examples, the two and back bar ends are identical, it is obvious that further enhancement of the patternoccurs if the top and back bar ends differ in color or dyeability.

EXAMPLE I

A 28-gauge, fully threaded tricot knitting machine is employed to produce three fabrics as identified in the Tables (Table Ia is the metric conversion for Table I). Yarn A, as previously described, is used throughout. Every other end is crossed (OxOx, etc.) in bands ten or more wales wide separated by much wider portions of normally knit fabrics. Fabrics I-A and I-B use the Modified Jersey stitch, and Fabric I-C uses the Jersey stitch.

Fabrics I-A and I-B, differing only in quality, runner lengths, and resulting weights, have particularly striking and attractive patterning within the bands containing the crossed ends. On the loop sides, normally knit wales are characterized by loops which zig-zag alternately right and left, all loops in a given course canted in the same direction. In the bands containing crossed ends, however, the same zig-zag of loops along a given wale occurs but adjacent loops along a given course are canted in opposite directions. The result is a very open, meshlike appearance heretofore unobtainable by basic tricot knitting. Moreover, each band has at its juncture with normally knit portions a wale with uncanted loops which frames the band in the fabric. It is apparent that bands of any width, including the full fabric width, can be so prepared.

Fabric I-C also has visible patterning bands, but they are not so strikingly differentiated from normally knit areas. Use of the Jersey stitch with alternating crossed ends provides more subdued patterns of longitudinal bands.

EXAMPLE II

A 32-gauge fully threaded tricot knitting machine is used to produce three fabrics with every thirty-second end crossed. Fabric II-A is prepared using the Jersey stitch, and fabrics II-B and II-C using the Delaware stitch. Each is further described in the Tables. Yarn B, as previously defined, was used throughout.

In all three fabrics narrow stripes of very tightly associated three-wale groupings are formed, each grouping including a crossed end and extending the full length of the fabric. Interwale spacings on each side of each grouping are wider than in the normally knit areas,thus accentuating the longitudinal, visually stripedeffect. The maximum float size in both Jersey and Delaware stitches is three needles wide, the crossed end having this float size accounting for the presence of three tightly spaced wales in the grouping. Four-needle floats produce four-wale groupings, etc. The number of normally knit wales between crossed ends may be varied to produce a variety of numbers and spacing of wale-grouped fabrics.

EXAMPLE III

Except for the spacing of crossed ends, four more fabrics are prepared as in Example II and as characterized in the Tables. Fabrics III-A, III-B, and III-C use the Delaware stitch; Fabric III-D uses the Jersey stitch. Except for differences in quality, runner length, and weight (as shown in the Tables) Fabrics III-A, III-B and III-C have equivalently patterned effects, but Fabric III-D is quite different. In all cases, the full fabric width is divided into six zones, each zone differing in spacing of crossed ends with the following regular repeating patterns; each pattern repeated:

Zone 1; OOX
Zone 2; OOOX
Zone 3; OOOOOX
Zone 4; OOOOOOOX
Zone 5; OOOOOOOOOOX
Zone 6; OOOOOOOOOOOOOOOX Considering the Delaware-stitch fabrics first, Zone 1 exhibits only a series of groupings of tightly associated three-wale bands, each band separated from the next by extra-wide interwale spacings. Zone 2 has tight three-wale groupings alternating with single normally knit wales, interwale spacings on each side of each three-wale grouping being extra-wide. Zone 3 is similar, having three normally knit and spaced wales between three-wale groupings. Zone 4 continues the same pattern, having five normally knit and spaced wales between three-wale groupings.

Figure 4:
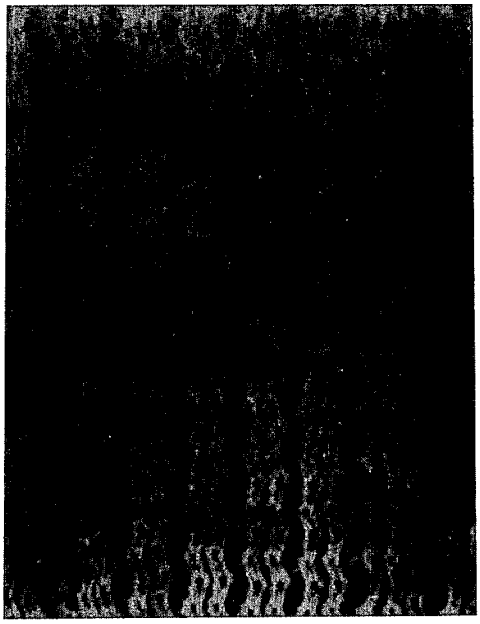
FIGS. 4 and 5 are photographs of fabric made as described in EXAMPLE III.

Zone 5 (as shown in FIG. 4) shows a new effect of spontaneous additional wale-shifting in the normally knit wales between three-wale groupings. Delaware-stitch fabrics have an inherent tendency to form random two-wale groupings. As seen in FIG. 4, when the ends are crossed to form three-wale groupings, the intervening normally knit wales also regularly associate into two-wale groupings continuously and uniformly throughout the length of the fabric. This additional wale-shifting occurs when an even number of normally knit wales is left between three-wale groupings. Although not shown in the Tables, two two-wale groupings occur between adjacent three-wale groupings when every seventh end is crossed. Thus, additional two-wale wale-shifted groupings occur when an even number (> 2) of normally knitted wales are formed between crossed ends. The effect using Long Float Delaware stitch (4-needle float) is analogous except that the groupings including crossed ends are composed of four wales and the additional groupings have three wales each. Thus, when every seventh or every eleventh end is crossed using Long Float Delaware stitch, one or two extra three-wale groupings are formed between the always obtained four-wale groupings including crossed ends.

Zone 6, having fifteen normally knit wales between crossed ends, shows a combination of these two effects. As in the previous fabrics, three-wale groupings including the crossed ends form. WIth such wide spacing between crossed ends, however, the fabric does not "know" whether there is an odd or even number of intervening wales. It therefore forms extra two-wale groupings on either side of the three-wale groupings. The remainingwales are substantially normally knitted and spaced.

Figure 5:
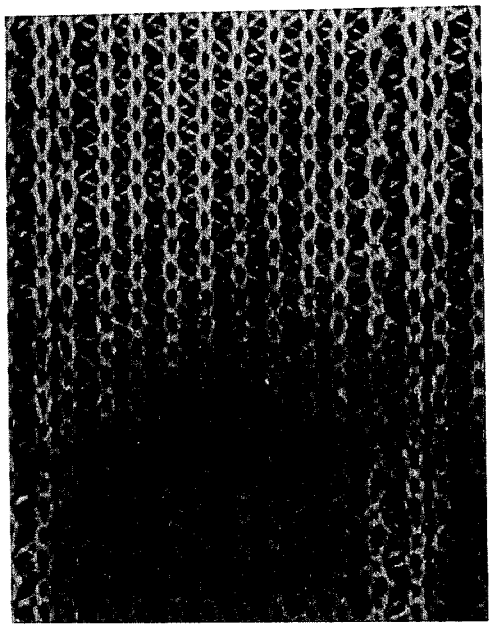

All Zones for Jersey-stitch fabric III-D showsimilar effects except that no additional wale shiftingoccurs between three-wale groupings including crossed ends. The three-wale groupings for these Jersey fabrics,-however, are split into a single wale with relativelylarge stitch loops and a two-wale group of distorted stitch loops, the remaining wales, if any, between adjacent crossed ends being normally knit and spaced. FIG. 5 shows Zone 5 of Fabric III-D.

EXAMPLE IV

Except for the spacings of crossed ends, these fabrics are prepared as described in Examples II and III. Fabric IV-B uses Jersey stitch, the remaining three use Delaware stitch. In all four fabrics, the spacing of crossed ends is in the following irregular repeating pattern across the full fabric width.

OXOOXOXOOXOOOOOO

A complicated combination of previously obtained longitudinally striped effects is obtained.

Jersey fabric IV-B exhibits no exaggerated interwale spacings. Instead it has groups of seven normally knit and spaced wales separated by groups of nine wales having varying degrees and types of distorted stitches.

The three Delaware-stitch fabrics all show distinct interwale spacing between groups of wales. Each shows a group of five normally knit and spaced wales separated from a wide, a still wider, and another wide close grouping of wales, in order. These multiple groupings provide a distinct and attractive pattern of uniform longitudinal bands.

EXAMPLE V

This example is just like Example IV except for a different spacing of crossed ends across the fabric width. The repeat pattern is

OOOXOX

Fabric V-B made using Jersey stitch, and Fabrics V-A and V-C with Delaware stitch. Although there are visually apparent stitch distortions along wales including crossed ends, Fabric V-B shows no spaced groupings. Fabrics V-A and V-C, however, show dense wale groupings alternating with single wales and separated from them by pronounced interwale spacings.

EXAMPLE VI

Previous examples have shown patterning effects achieved when, at spaced single-needle locations, front and back bar ends are interchanged at their guide bars. This example shows patterning effects obtained when, at each of the spaced single-needle locations, only one end is crossed.

Three fabrics were knitted, finished, and dyed to a deep red color. Yarn B, as previously described, was used in all cases. A commercial 32-gauge 2-bar warp-knitting machine was employed. Runner lengths and fabric properties were shown in Tables II and IIa.

For fabrics VI-A and VI-B, both the front guide bar and the back guide bar were fully threaded initially from their corresponding beams. Then selected ends were crossed according to the following pattern repeated across the width of the fabric:

1. Cut position 1 back bar end, cross it to position 1 of the front bar, and knit it together with the front bar end already in this guide bar position as if the two yarns were a single front bar end.
2. Leave the next 30 positions as initially threaded.
3. Cut position 32 front bar end, cross it to position 32 of the back bar, and knit it together with the back bar end already in this guide bar position as if the two yarns were a single back bar end.
4. Leave the next 30 positions as initially threaded.

Figures 1A, 1B, 1C, 1D, 1E, 1F, 1G, 1H, 1I, 1J:
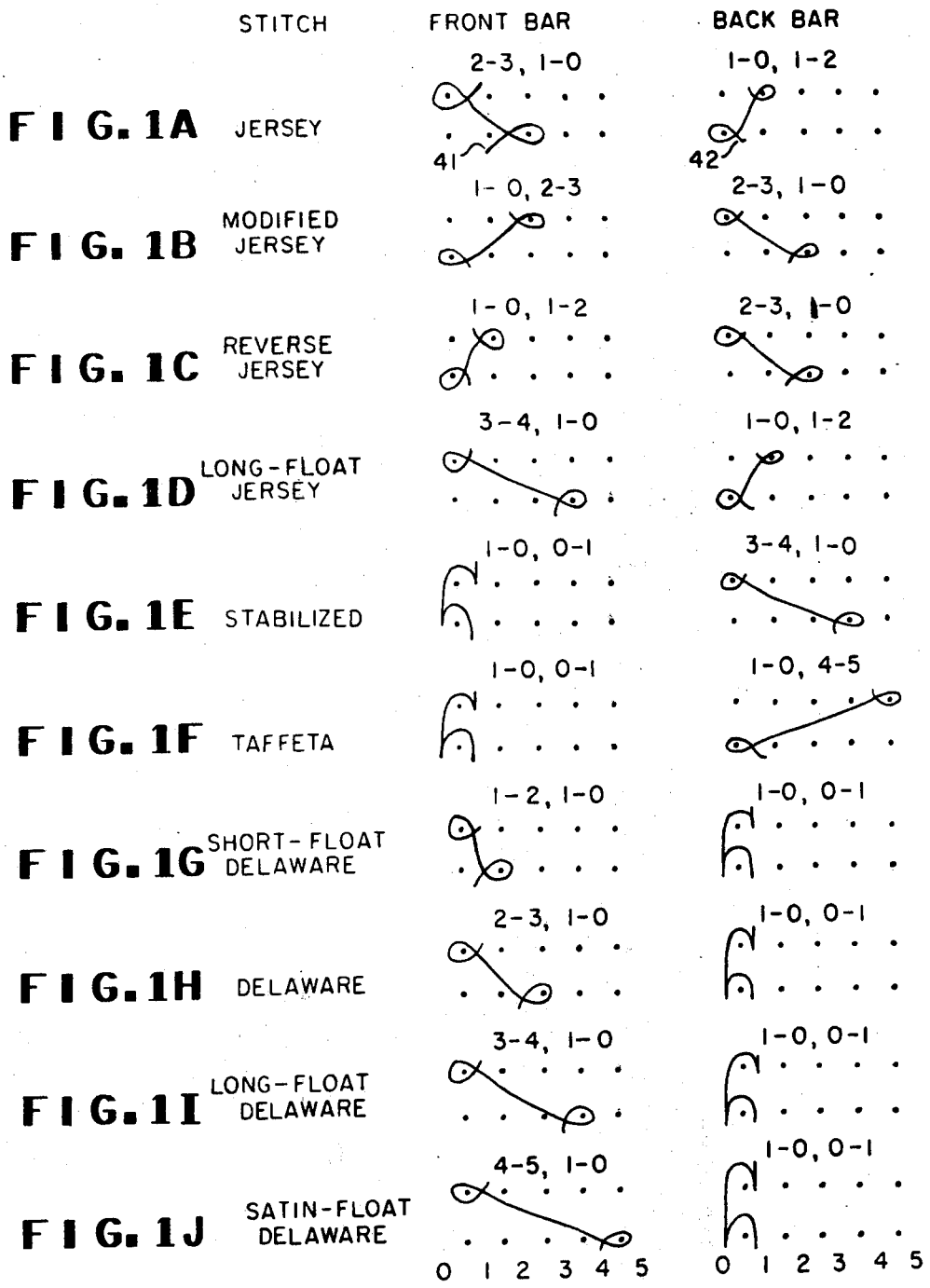
FIGS. 1A to 1J are stitch pattern diagrams for different types of basic warp-knitting with the front and back bars of each stitch construction shown separately.

Fabric VI-A was knit using the Jersey stitch (FIG. 1A). As viewed on the loop face of the finished and

TABLE I

| Fabric | Runner Length (in.) Top Bar | Runner Length (in.) Back Bar | Quality (in.) | Greige Properties Width (in.) | Greige Properties Weight (oz./yd.²) | Greige Properties Count (W/C) in.⁻¹ | Finished Properties Width (in.) | Finished Properties Weight (oz./yd.²) | Finished Properties Count (W/C) in.⁻¹ |
|---|---|---|---|---|---|---|---|---|---|
| I-A | 72.5 | 57.5 | 8 | 30 | 2.22 | 39 × 51 | 25.5 | 1.85 | 45 × 41 |
| I-B | 72.5 | 55 | 10 | 29 | 2.25 | 39 × 53 | 25 | 2.12 | 45 × 45 |
| I-C | 70 | 56.25 | 10 | 33.25 | 2.15 | 40 × 50 | 25 | 2.18 | 46 × 44 |
| II-A | 58 | 42 | 8 | 67 | 2.07 | 41 × 60 | 55 | 2.45 | 46 × 62 |
| II-B | 50 | 36.5 | 6 | 77.25 | 2.22 | 34 × 86 | 61.5 | 2.64 | 42 × 85 |
| II-C | 48 | 36 | 5.5 | 75.5 | 2.33 | 35 × 95 | 64.38 | 2.72 | 40 × 93 |
| III-A | 66 | 54 | 12 | — | — | — | 15.75 | 1.55 | 39 × 41 |
| III-B | 63 | 45 | 10 | — | — | — | 15.75 | 1.77 | 38 × 56 |
| III-C | 60 | 41 | 8 | 18 | 1.94 | 35 × 65 | 15.5 | 2.05 | 36 × 65 |
| III-D | 63 | 46 | 9.75 | 16 | 2.10 | 44 × 50 | 14 | 1.61 | 38 × 50 |
| IV-A | 64 | 39 | 7.75 | 39 | 1.88 | 34 × 64 | 35.5 | 2.30 | 36 × 70 |
| IV-B | 60.75 | 43.5 | 7.75 | 33 | 2.20 | 39 × 60 | 26.88 | 2.48 | 47 × 62 |
| IV-C | 68 | 42 | 9 | 39.25 | 1.74 | 32 × 56 | 36.5 | 2.17 | 35 × 62 |
| IV-D | 58 | 34.25 | 6.88 | 37.5 | 2.03 | 32 × 74 | 31.5 | 2.73 | 34 × 87 |
| V-A | 64 | 39 | 7.75 | 33.25 | 2.29 | 37 × 67 | 29.5 | 3.07 | 41× 82 |
| V-B | 60.75 | 43.5 | 7.75 | 31.75 | 2.28 | 36 × 64 | 28.25 | 2.68 | 48 × 66 |
| V-C | 68 | 42 | 9 | 33.5 | 2.07 | 37 × 60 | 31 | 2.65 | 41 × 70 |

TABLE Ia

| Fabric | Runner Length (m.) Top Bar | Runner Length (m.) Back Bar | Quality (cm.) | Metric Conversions Greige Properties Width (m.) | Greige Properties Weight (gm/100cm²) | Greige Properties Count (W/C cm⁻¹) | Finished Properties Width (m.) | Finished Properties Weight (gm/100cm²) | Finished Properties Count (W/C cm⁻¹) |
|---|---|---|---|---|---|---|---|---|---|
| I-A | 1.842 | 1.461 | 20.3 | .762 | .753 | 15.4 × 20.1 | 0.648 | .628 | 17.7 × 16.1 |
| I-B | 1.842 | 1.397 | 25.4 | .737 | .764 | 15.4 × 20.9 | 0.635 | .719 | 17.7 × 17.7 |
| I-C | 1.778 | 1.429 | 25.4 | .845 | .730 | 15.7 × 19.7 | 0.635 | .740 | 18.1 × 17.3 |
| II-A | 1.473 | 1.067 | 20.3 | 1.702 | .702 | 16.1 × 23.6 | 1.397 | .831 | 18.1 × 24.4 |
| II-B | 1.270 | 0.927 | 15.2 | 1.962 | .753 | 13.4 × 33.9 | 1.562 | .896 | 16.5 × 33.5 |
| II-C | 1.219 | 0.914 | 14.0 | 1.918 | .791 | 13.8 × 37.4 | 1.635 | .923 | 15.7 × 36.6 |
| III-A | 1.676 | 1.372 | 30.5 | — | — | — | 0.400 | .526 | 15.4 × 16.1 |
| III-B | 1.600 | 1.143 | 25.4 | — | — | — | 0.400 | .601 | 15.0 × 22.0 |
| III-C | 1.524 | 1.041 | 20.3 | 0.457 | .658 | 13.8 × 25.6 | 0.394 | .696 | 14.2 × 25.6 |
| III-D | 1.600 | 1.168 | 24.8 | 0.406 | .713 | 17.3 × 19.7 | 0.356 | .546 | 15.0 × 19.7 |
| IV-A | 1.626 | 0.991 | 19.7 | 0.991 | .638 | 13.4 × 25.2 | 0.902 | .781 | 14.2 × 27.6 |
| IV-B | 1.543 | 1.105 | 19.7 | 0.838 | .747 | 15.4 × 23.6 | 0.683 | .842 | 18.5 × 35.5 |
| IV-C | 1.727 | 1.067 | 22.9 | 0.997 | .590 | 12.6 × 22.0 | 0.927 | .736 | 13.8 × 24.4 |
| IV-D | 1.473 | 0.870 | 17.5 | 0.953 | .689 | 12.6 × 29.1 | 0.800 | .926 | 13.4 × 34.3 |
| V-A | 1.626 | 0.991 | 19.7 | 0.845 | .777 | 14.6 × 26.4 | 0.749 | 1.042 | 16.1 × 32.3 |
| V-B | 1.543 | 1.105 | 19.7 | 0.806 | .774 | 14.2 × 25.2 | 0.718 | .909 | 18.9 × 26.0 |
| V-C | 1.727 | 1.067 | 22.9 | 0.851 | .702 | 14.6 × 23.6 | 0.787 | .899 | 16.1 × 27.6 |

dyed fabric, a visibly distinct and continuous stripe was evident throughout the length of the fabric corresponding in position with each crossed end. The position 1 visible stripes were about 3.6 normal wale-widths wide, and the position 32 stripes about 3.0 normal wale-widths wide. Examined microscopically, end position 1 stripe was found to comprise a central substantially normal wale bounded on both sides by about wale-width spacings occupied only by straight substantially transverse thread portions. In addition, one wale bounding each outside edge of these spacings had distorted stitches. The position 32 stripes contained two side-by-side rows of loop-free distorted stitches, one more open and wider than the other and both less opaque than areas formed of normal wales.

Fabric VI-B used threading identical to that of Fabric VI-A, but was knitted using the Delaware stitch (FIG. 1H). Viewed by eye the position 1 stripes were seen to extend over about 18 normal wale-widths. Viewed microscopically, however, each was composed of a central substantially normal wale with greater thn wale-width spacings on both sides containing loop-free substantially transverse thread portions. Remaining wales on both sides of the above-described portion were substantially normal in appearance but had slightly enlarged interwale spacings between pairs of wales, diminishing in size with increased distance from the central wale. The position 32 stripes examined by eye were at least 14 normal wale-widths wide. Microscopically they were seen to comprise a central pair of tightly adjacent wales bounded on one side by a greater than wale-width spacing and on the other by a slightly widened interwale spacing. Moving outward from either side of the above portion, larger than normal interwale spacings, diminishing in width, were observed between pairs of otherwise normal wales.

Fabric VI-C used the Delaware switch as in Fabric VI-B, but both supply beams were partial. As initially threaded, the front guide bar had an end missing at each position 1 of a 62 position repeat, and each back guide bar had an end missing at each position 32. Then, at each position 1 and position 32 the normally threaded end was cut and crossed to be threaded through the empty position of the other guide bar. Viewed by eye, the finished and dyed loop face of this fabric looked almost exactly like Fabric VI-B except that the visual wale-shifting effect at each position was over slightly less fabric width. The central wale at each position 1, however, was so distorted as to hardly be recognized as a wale, and the interwale spacings on each side of it were wider and even less opaque.

TABLE II

| Fabric | Runner Length (in.) Top Bar | Runner Length (in.) Back Bar | Quality (in.) | Wigth (in.) | Greige Properties Weight (oz/yd²) | Greige Properties Count (W/C) in⁻¹ | Finished Properties Weight (oz/yd²) | Finished Properties Count (W/C) in⁻¹ |
|---|---|---|---|---|---|---|---|---|
| VI-A | 58 | 43 | 8 | 63 | 2.1 | 42 × 60 | 2.6 | 46 × 64 |
| VI-B | 53 | 34 | 6 | 77 | 2.0 | 34/80 | 2.4 | 34/100 |
| VI-C | 53 | 34 | 6 | 78 | 2.0 | 34/79 | 2.2 | 38/92 |

Table IIa

| Fabric | Runner Length (m.) Top Bar | Runner Length (m.) Back Bar | Quality (cm.) | Width (m.) | Weight (gm./100 cm²) | Count (W/C) cm⁻¹ | Weight (g/100 cm²) | Count (W × C) cm⁻¹ |
|---|---|---|---|---|---|---|---|---|
| VI-A | 1.47 | 1.09 | 3.15 | 1.60 | .713 | 16.5 × 23.6 | .882 | 18.1 × 25.2 |
| VI-B | 1.35 | 0.86 | 2.36 | 1.96 | .679 | 13.4 × 31.5 | .814 | 13.4 × 39.4 |
| VI-C | 1.35 | 0.86 | 2.36 | 1.98 | .679 | 13.4 × 31.1 | .747 | 15.0 × 36.2 |

What is claimed is:

1. In a method for producing warp-knitted fabrics on a warp-knitting machine having at least two sets of warp threads and corresponding operating guide bars, including the steps of feeding one of said two sets of threads to one of two operating guide bars of said warp-knitting machine and feeding the other of said two sets to the other operating guide bar of said warp-knitting machine to form a knitted fabric, the improvement comprising: interchanging some of the threads from said one set of threads with threads of the other of said set of threads in a spaced pattern ahead of said operating guide bars on said knitting machine.

2. The method of claim 1, said spaced patternbeing a regular spaced repeating pattern, some threads from said one set of threads being interchanged with corresponding threads of said other set of threads.

3. The method of claim 2, said regular spaced repeating pattern being an interchange of every other thread.

4. The method of claim 2, said regular spaced repeating pattern being an interchange of every third thread.

5. The method of claim 2, said regular spaced repeating pattern being an interchange of every fourth thread.

6. The method of claim 2, said regular spaced repeating pattern being an interchange of every sixth thread.

7. The method of claim 2, said regular spaced repeating pattern being an interchange of every eighth thread.

8. The method of claim 2, said regular spaced repeating pattern being an interchange of every eleventh thread.

9. The method of claim 2, said regular spaced repeating pattern being an interchange of every sixteenth thread.

10. The method of claim 2, said regular spaced repeating pattern being an interchange of every thirtysecond thread.

11. The method of claim 1 wherein said spaced pattern is an irregularly spaced repeating pattern.

12. The method of claim 11, said irregular spaced repeating pattern being an interchange of every second, then fifth, then seventh, and then tenth thread followed by six normally threaded threads.

13. The method of claim 11, said irregular spaced repeating pattern being an interchange of every fourth, then sixth thread.

14. In a method for producing warp-knitted fabrics on a warp-knitting machine having at least two sets of warp threads and corresponding operating guide bars, including the steps of feeding one of said two sets of threads to one of two operating guide bars of said warp-knitting machine and feeding the other of said two sets to the other operating guide bar of said warp-knitting machine to form a knitted fabric, the improvement comprising: crossing at least one of the threads from said one set of threads from one operating guide bar to the other operating guide bar in a spaced pattern ahead of said operating guide bars on said knitting machine.

15. The method of claim 14 wherein said spaced pattern is a regular spaced repeating pattern.

16. The method of claim 15, said regular spaced repeating pattern being a crossing of every thirty-second thread.

* * * * *

UNITED STATES PATENT OFFICE
CERTIFICATE OF CORRECTION

PATENT NO. : 4,020,654
DATED : May 3, 1977
INVENTOR(S) : Bharat Jaybhadra Gajjar It is certified that error appears in the above-identified patent and that said Letters Patent are hereby corrected as shown below:

Col. 1, line 13, Change "Raschelmachines" to -- Raschel machines --

Col. 1, line 27, Change "complicted" to -- complicated --

Col. 2, line 62, Change "two" to -- top --

Col. 2, line 66, Change "aare" to -- are --

Col. 3, line 25, Change "results" to -- result --

Col. 3, line 41, Change "spun-stable" to -- spun-staple --

Col. 4, line 31, Change "twobar" to -- two-bar --

Col. 4, line 61, Change "atractive" to -- attractive --

Col. 4, line 65, Change "two" to -- top --

Col. 4, line 67, Change "patternoccurs" to -- pattern occurs --

Col. 5, line 45, Change "stripedeffect" to -- striped effect --

Col. 6, line 45, Change "WIth" to -- with --

Col. 6, line 52, Change "showsimilar" to -- show similar --

Col. 6, line 53, Change "shiftingoccurs" to -- shifting occurs --

Col. 6, line 56, Change "relativelylarge" to -- relatively large --

Col. 8, line 13, Change "were" to -- are --

Col. 9, line 25, Change "end" to -- each --

UNITED STATES PATENT OFFICE

CERTIFICATE OF CORRECTION

PATENT NO. : 4,020,654
DATED : May 3, 1977
INVENTOR(S) : Bharat Jaybhadra Gajjar It is certified that error appears in the above-identified patent and that said Letters Patent are hereby corrected as shown below:

Col. 9, line 40, Change "thn" to -- than --

Col. 9, line 56, Change "switch" to -- stitch --

Col. 10, line 34, Change "pattembeing" to -- pattern being --

Col. 10, line 55-56, Change "thirtysecond" to -- thirty-second --

Table Ia, Col. 10, line 12, Change "18.5 x 35.5" to -- 18.5 x 24.4 --

Table II, Col. 5 (heading), Change "wigth" to -- width --

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*